US009604111B2

(12) United States Patent
Brooks

(10) Patent No.: US 9,604,111 B2
(45) Date of Patent: Mar. 28, 2017

(54) GAME OF HORSESHOES

(71) Applicant: Calvin L Brooks, Elon, NC (US)

(72) Inventor: Calvin L Brooks, Elon, NC (US)

( * ) Notice: Subject to any disclaimer, the term of this patent is extended or adjusted under 35 U.S.C. 154(b) by 0 days.

(21) Appl. No.: 14/708,258

(22) Filed: May 10, 2015

(65) Prior Publication Data

US 2016/0325164 A1 Nov. 10, 2016

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
CPC ..... A63B 67/06
USPC ..... 273/336
See application file for complete search history.

(56) References Cited

U.S. PATENT DOCUMENTS 143,047 A 9/1873 West
1,113,969 A * 10/1914 Ekelund ..... A63F 9/02 273/337
1,583,250 A 5/1926 Heath et al.
1,595,527 A * 8/1926 Schacht ..... A63F 9/0208 273/339
2,265,517 A 12/1941 Clement
2,472,719 A * 6/1949 Mysels ..... A63B 67/06 273/338
D195,631 S * 7/1963 Klingaman ..... D21/304
3,326,556 A * 6/1967 Andersen ..... A63F 9/02 198/394
3,356,368 A * 12/1967 Dixon ..... A63F 9/0204 273/336
3,507,496 A * 4/1970 Miller ..... A63B 67/06 273/339
3,547,442 A * 12/1970 Fenicchia ..... A63F 9/0204 273/336
3,602,509 A * 8/1971 Curtiss ..... A63B 67/06 273/339
3,640,535 A * 2/1972 Gendler ..... A63F 9/02 273/126 R
3,773,330 A 11/1973 Glass et al.
3,844,560 A * 10/1974 Litsch ..... A63B 67/06 273/336
3,934,879 A * 1/1976 Curtiss ..... A63B 67/06 273/339

(Continued)

OTHER PUBLICATIONS http://www.horseshoebay.com/slickrgolf.html (Waterfall) (NPL 1).

*Primary Examiner* — Aarti B Berdichevsky
*Assistant Examiner* — Dolores Collins
(74) *Attorney, Agent, or Firm* — Michael E. Zall

(57) ABSTRACT

A substantially planar playing field for a horseshoe game. A plurality of horseshoe courses are arranged on the playing field. Each of the horseshoe courses comprises an elongated planar portion having opposed ends and a horseshoe pit on at least one of the opposed ends of the elongated planar portion. A plurality of the horseshoe courses on the playing field have a horseshoe pit on each of the opposed ends of the elongated planar portion of the horse shoe course. Each of the pits has a stake rising above the pit. At least one, and preferably a plurality of the courses have included in the horseshoe course a challenge for the player. The courses are arranged on the playing field to enable the players to traverse a predetermined game path to play each course in sequence to complete the game.

10 Claims, 14 Drawing Sheets

(56) References Cited

U.S. PATENT DOCUMENTS 4,130,281 A * 12/1978 Leber ..... A63B 47/024 273/336
4,203,592 A * 5/1980 Quatkemeyer ..... A63B 67/06 273/336
4,789,163 A * 12/1988 Warner ..... A63F 9/02 273/336
4,927,159 A * 5/1990 Morrissey ..... A63B 67/06 273/338
4,936,590 A 6/1990 Palmer
4,952,073 A * 8/1990 Wieland ..... A63B 67/06 273/336
5,358,256 A 10/1994 Kraemer
5,575,483 A * 11/1996 Dineen ..... A63B 67/06 273/317.2
D462,092 S * 8/2002 Temple ..... D21/303
6,988,964 B2 * 1/2006 Buckfield ..... A63B 67/066 473/415
7,121,963 B2 10/2006 Corbin et al.
7,241,227 B2 7/2007 Campbell
7,726,656 B1 * 6/2010 Kuchcinski ..... A63B 67/06 273/336
7,905,489 B2 * 3/2011 Cornfield ..... A63B 67/06 273/317
7,967,295 B1 * 6/2011 Laukaitus ..... A63B 67/06 273/317
8,702,528 B1 * 4/2014 Montgomery ..... A63B 67/02 473/150
8,881,918 B2 * 11/2014 Nally ..... A63B 67/06 108/147.13
8,905,405 B1 * 12/2014 Burns, Sr. ..... A63B 67/06 273/336
2003/0098545 A1 * 5/2003 Webb ..... A63B 63/00 273/343
2007/0037629 A1 2/2007 Neal
2008/0116644 A1 * 5/2008 Knoernschild ..... A63B 67/06 273/336
2009/0033034 A1 * 2/2009 Jakubowski ..... A63B 67/002 273/348
2010/0090406 A1 4/2010 De Mello

* cited by examiner

GAME OF HORSESHOES

BACKGROUND OF THE INVENTION

Field of the Invention

The present invention is directed to a game, and in particular relates to an improved game of horseshoes. More particularly, the game is designed for two or more players that require navigating a large playing field containing a plurality of horseshoe courses arranged for sequentially playing each course, at least one of the courses, and preferably at least a majority of the courses have different configurations of challenges, including objects, obstacles and hazards.

Description of the Related Art

The history of the game of horseshoes is believed to date back to the second century AD wherein soldiers or athletes would toss horseshoes from a distance towards a small stake or target area placed in the ground and attempt to outscore their opponent by throwing their horseshoe closest to the stake or post or around the stake or post.

A horseshoe is generally a U-shaped metal piece that is used to protect horse hoofs from wear. Modern horseshoes for the game are about twice the size of horseshoes used on horses and may be made of varying materials, e.g., plastic, wood, metal.

The current game of horseshoes is a sport typically played outdoors between two players and can also be played by two teams of two players each. In the two player game each player uses two horseshoes. The course is an elongated planar portion having opposed ends and a horseshoe pit on both of the opposed ends of the elongated planar portion. Each pit has a stake rising above the pit. Both players stand at one end of the course. The players take alternate turns tossing horseshoes at the upright stake in the opposite, second horseshoe pit. After scoring their respective points the players then repeat the process, tossing their horseshoes towards the original, first horseshoe pit and stake and adding additional points to their scores. The players continue back and forth within the same course until a final point total is reached. There is an established method of scoring and for the sake of brevity will not be detailed here.

The rules of play for horseshoes have changed many times over the years with the current final dimensions of horseshoes, horseshoe pits, stakes & distances being last established in 1950 and the scoring system has remained unchanged since 1982. The aforementioned rules are for tournament play and were set under the governing body of the National Horseshoe Pitchers Association of America.

The game of horseshoes has survived for many years for numerous reasons. It is quite simple in nature but yet very challenging to become skilled. There are various methods of throwing horseshoes that people are constantly striving to improve upon, similar in fashion to the game of golf. It does not require a costly outlay to create a horseshoe course and associated pits in one's backyard for recreational purposes. Games involving hand eye coordination inherently solicit involvement and the game of horseshoes is one of the most accessible and inexpensive games one can play. Regarding tournament play, there is the aspiration to become a top player in the game.

Applicant is aware of the following prior art:

US 2007/0037629 A1 to Neal.
US 2009/0033034 A1 to Jakubowski.
US 2010/0090406 A1 to De Mello
U.S. Pat. No. 0,143,047 A to West
U.S. Pat. No. 1,583,250 A to Heath U.S. Pat. No. 2,265,517 A to Clement
U.S. Pat. No. 3,507,496 A to Miller
U.S. Pat. No. 3,773,330 A to Glass
U.S. Pat. No. 3,934,879 A to Curtiss.
U.S. Pat. No. 4,927,159 A to Morrissey
U.S. Pat. No. 4,936,590 A to Palmer
U.S. Pat. No. 5,358,256 A to Kraemer
U.S. Pat. No. 7,121,963 B2 to Corbin
*U.S. Pat. No. 7,241,227 B2 to Campbell.

The following non-patent reference:

http://www.horseshoebay.com/slickrgolf.html (Waterfall) (NPL 1)

OBJECTS AND SUMMARY OF INVENTION

It is an object of this invention to provide a new and novel game particularly suited for use as an outdoor field game, but which may also be used as an indoor game, as desired.

It is another object of this invention to provide a game with great versatility for recreational and amusement purposes as well as giving physical benefits to persons of practically all ages.

It is thus object of this invention to provide an improved game of horseshoes.

It is further object of this invention to provide a novel playing field for the game of horseshoes and method of playing the game that is more complex and challenging than the known game.

The above objects are achieved by a novel playing field for a horse shoe game for use by players. The playing field is a substantially planar playing field, although it may traverse gently rolling hills. There is a plurality of horseshoe courses arranged on the playing field. Each of the horseshoe courses comprises an elongated planar portion having opposed ends and a horseshoe pit on at least one of the opposed ends of the elongated planar portion. A plurality of the horseshoe courses on the playing field have a horseshoe pit on each of the opposed ends of the elongated planar portion of the horse shoe course. Each of the pits has a stake rising above the pit. At least one, and preferably a plurality of the courses have included in the horseshoe course a challenge for the player. The courses are arranged on the playing field to enable the players to traverse a predetermined game path to play each course in sequence to complete the game. The game may be adapted as a digital game to be played on a video screen, PC, I-Pad® and I-Phone® type devices.

Other objects and advantages of the invention will become apparent in the following description and accompanying drawings.

BRIEF DESCRIPTION OF THE DRAWINGS

The novel features believed to be characteristic of the present invention, together with further advantages thereof, will be better understood from the following description considered in connection with the accompanying drawings in which several embodiments of the invention are illustrated by way of example. It is to be expressly understood, however, that the drawings are for the purpose of illustration and description only and are not intended as a definition of the limits of the invention.

DETAILED DESCRIPTION OF THE INVENTION

Figure 1:
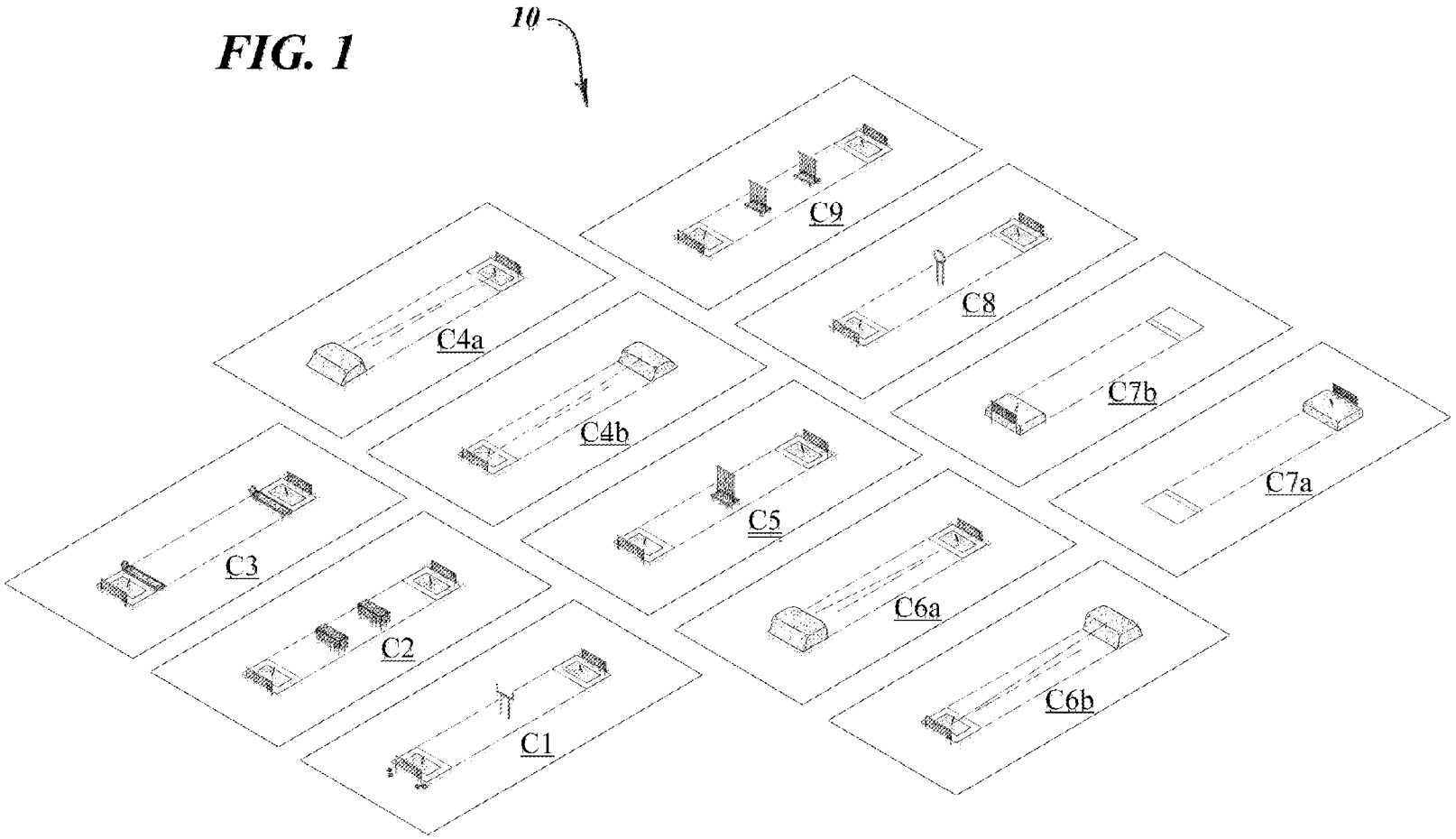
FIG. 1 is an aerial isometric view of one embodiment of the Horseshoe game of the present invention.

It shall be noted that like reference numerals are used throughout the drawing figures and the drawings are representative of various embodiments that may be employed within the scope of the present invention.

Referring to FIG. 1, there are a series of horseshoe courses that comprise the overall game course shown generally as 10. Players will start at course C1 and sequentially play throughout the overall game in a serpentine pattern through the course 10, i.e., C1, C2, and C3, et seq., finishing the game on course C9. Each of the courses will be described in greater detail below with respect to their associated drawings. Each course presents a different type of challenge and the scoring method for points earned can be derived from conventional scoring rules or be adjusted for various age groups, tournaments, handicaps and so on.

The overall course or playing field 10 allows for walkways between adjacent courses as well as any signage (not shown) to help direct players throughout the game. A structure (not shown) may optionally be positioned at the start of the game for collection of fees, distribution of horseshoes and scorecards, concession area & park benches. Provisions can be made to supply drying towels for patrons during play on the water feature courses. Players could use the same set of horseshoes throughout the game or alternatively each course could have a dedicated set of horseshoes available for the next round of players.

Figure 2:
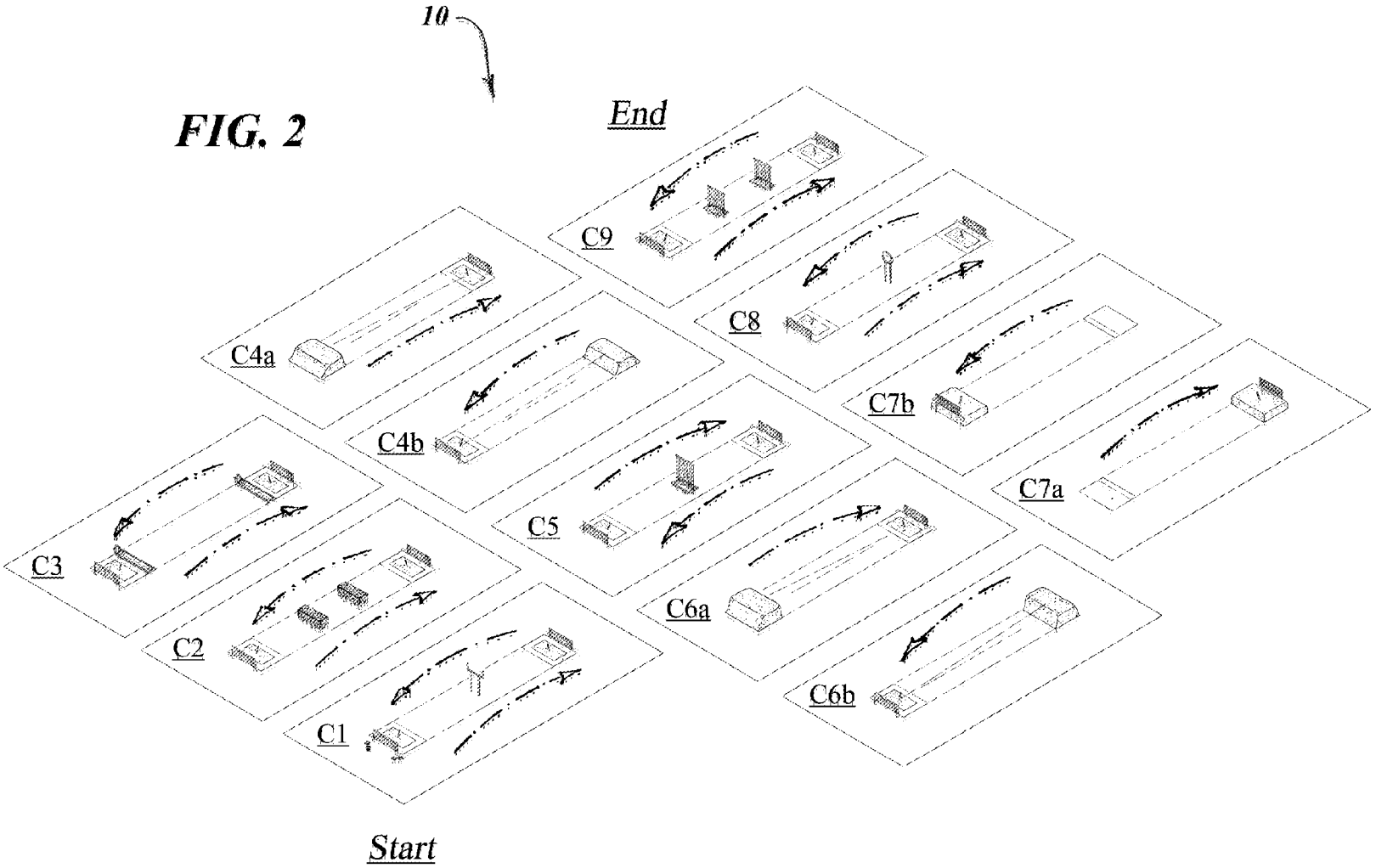
FIG. 2 is an aerial isometric view similar to FIG. 1 showing the flow and sequence of the game.

Referring now to FIG. 2, the flow and sequence of the game can be understood. The overall game starts on course C1 and the players take turns tossing horseshoes in one direction towards a first horseshoe pit or pit area, then reverse direction and toss horseshoes at the opposite second horseshoe pit as shown by the arrows in the drawing, tallying scores after each round of throwing which will be described in greater detail below.

It should be understood that the terms tossing, throwing & pitching of horseshoes can be used interchangeably and all mean the same action which is physically directing a horseshoe in a trajectory path towards the opposite horseshoe pit and upright stake.

Continuing the game from course C1 the players then proceed to course C2 and repeat the process of tossing their respective horseshoes similar to course C1. This pattern continues throughout the game for courses C1, C2, C3, C5, C8 and C9. Courses C4, C6 and C7 are divided into two courses which are labeled C4*a*, C4*b*, C6*a*, C6*b*, C7*a* and C7*b* respectively. These courses are asymmetrical due to the challenges which will be described in greater detail below. After players finish course C3 they will then proceed to course C4*a* for one direction of tossing horseshoes. Players will then move to course C4*b* to toss horseshoes in the opposite direction. The same practice applies for courses C6*a* & C6*b* and C7A & C7*b*.

Figure 3:
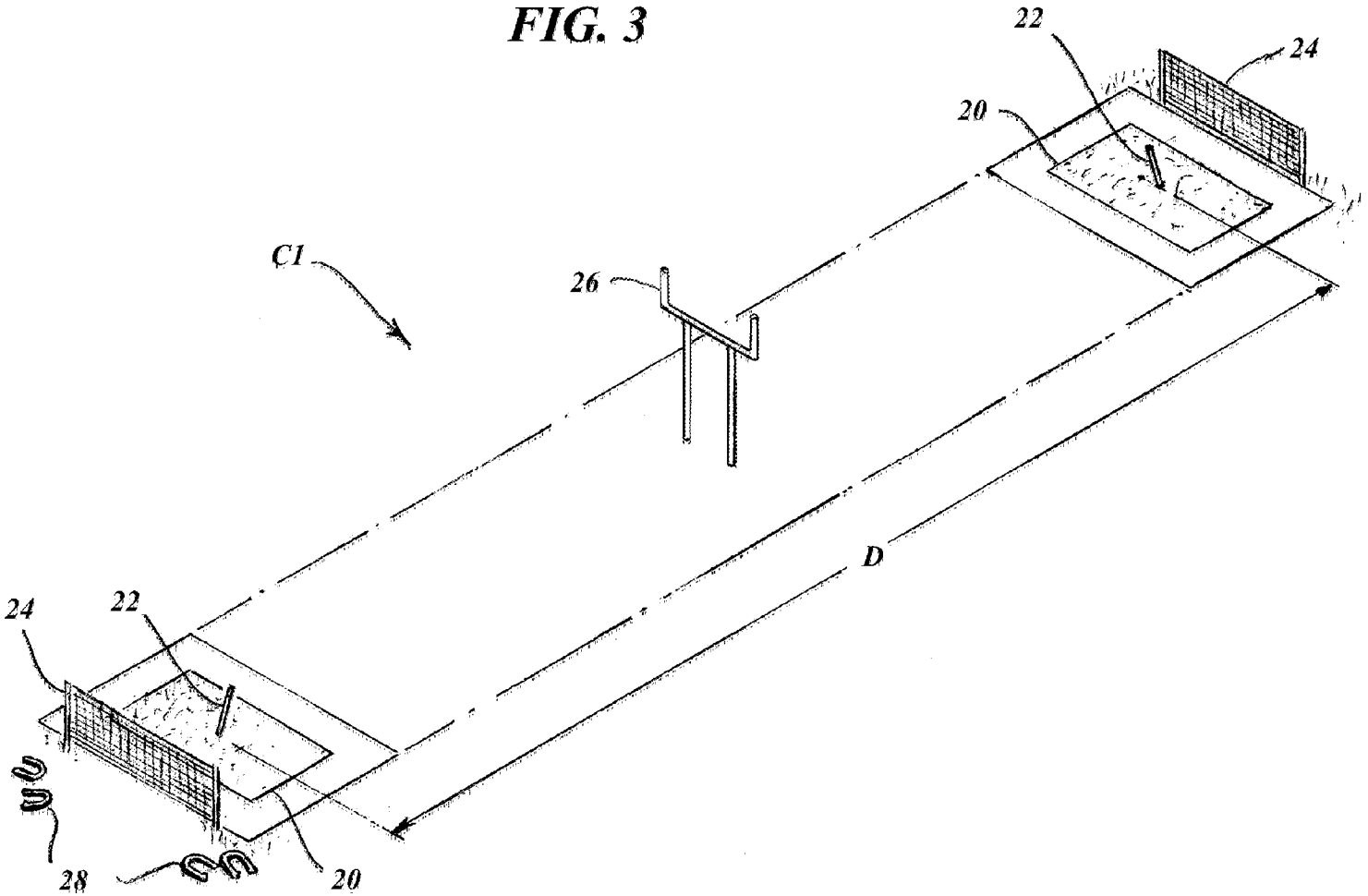
FIG. 3 is an enlarged isometric view of the first course C1.

Referring to FIG. 3, it depicts an isolated view of course C1 (Starting Gate) showing the details and configuration of the horseshoe pit layout. It should be realized that all dimensions herein are the preferred dimensions, but other dimensions may be used for various reasons. Located at each end is a horseshoe pit 20 that is 40 inches×70 inches and has about 3 inches depth of sand. Central to each pit is positioned a metal stake 22 projecting 16 inches above the pit at a slight inward angle. Safety nets 24 measuring 70 inches wide and 24 inches high are placed at the extreme ends of the course to prevent horseshoes 28 from crossing into adjacent horseshoe courses. The distance D between stakes 22 is 38 feet. Centrally located is an obstacle or challenge 26 which is comprised of an upper U-shaped bar 40 inches high supported by two posts spaced apart to allow the players to view the stake 22 at the opposite end. The objective is to throw the horseshoe over the obstacle 26 and towards the opposing stake 22 at the other end of course C1.

The general dimensions of each course as described above are similar for all courses within the overall game and the subsequent descriptions for the remaining courses will focus on details comprising the obstacles and/or challenges for each one.

Figure 4:
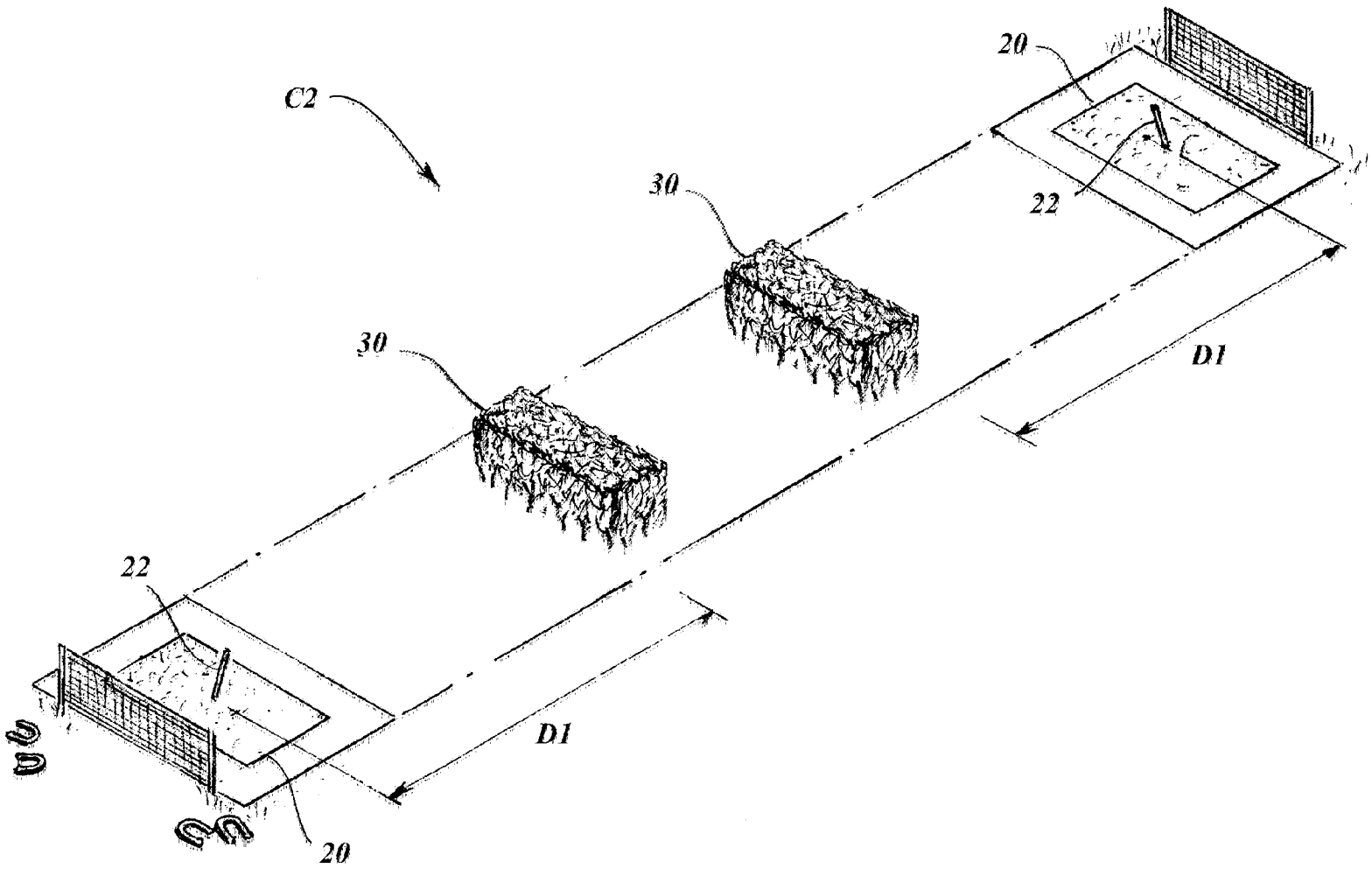
FIG. 4 is an enlarged isometric view of the second course C2.

FIG. 4 shows course C2 (Hedge Catcher) in greater detail. In this challenge the players attempt to successfully throw their horseshoes over two hedges 30. The hedges 30 are 24 inches tall by 24 inches deep by 70 inches wide and are positioned at a distance D1 of 13 feet from the stakes 22.

Figure 5:
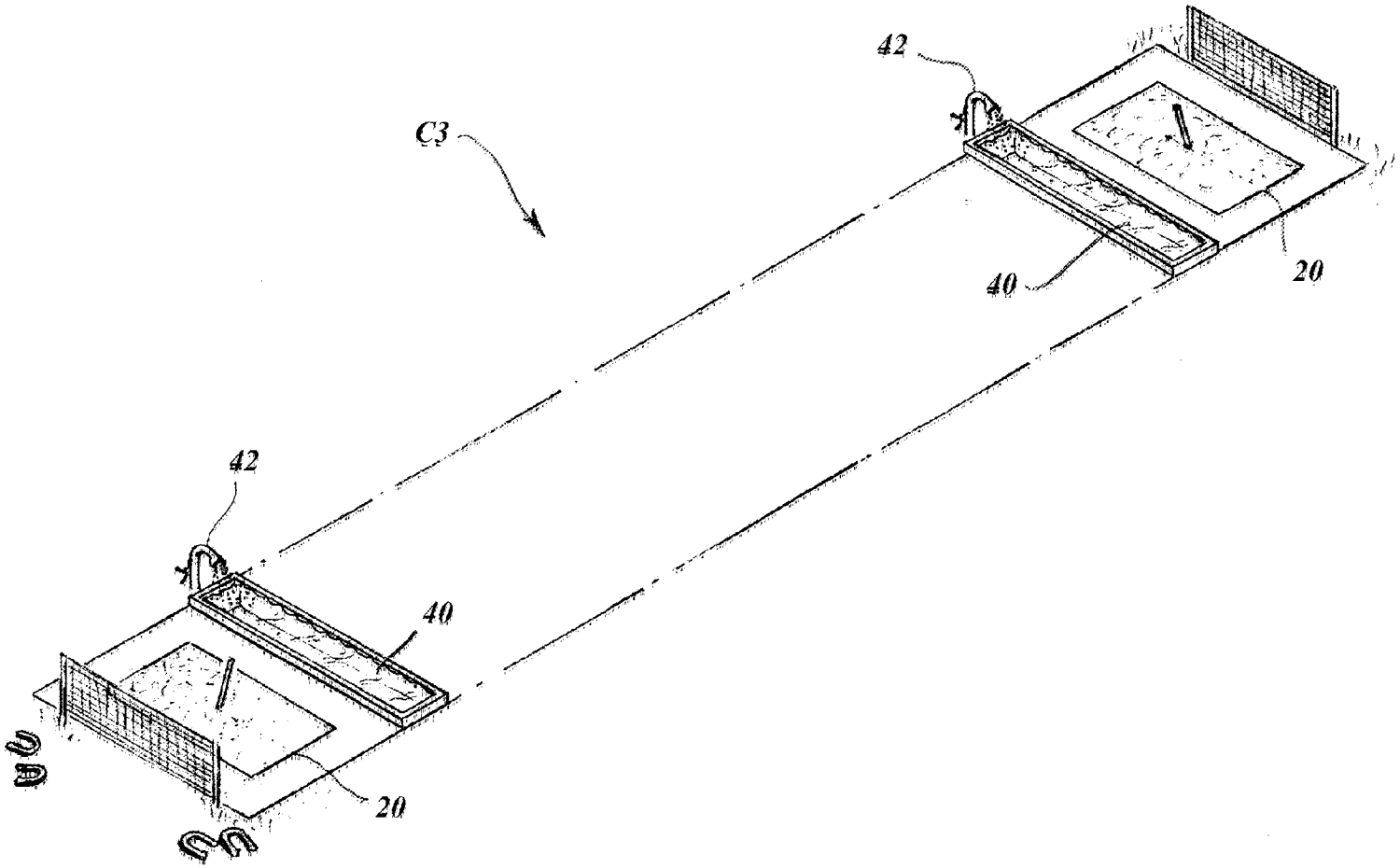
FIG. 5 is an enlarged isometric view of the third course C3.

FIG. 5 illustrates course C3 (Water Biscuit) wherein the challenge is a pair of small ponds 40 positioned in front of each horseshoe pit 20. Each pond 40 is 2 inches higher than the horseshoe pit 20 and measures 70 inches wide and are 6 inches deep. A water spout 42 may be positioned at each edge or centrally within pond 40 to create a spray mist. The players must throw over the ponds 40 in order to score points. An object is to avoid throwing the horseshoes and landing in the ponds 40. There can be a deduction of, for example, one point for every player's shoe that is fully or partially submerged in the pond 40. Additionally, horseshoes that get wet at any time during the game can be exchanged for another horseshoe or towel dried.

Figure 6A:
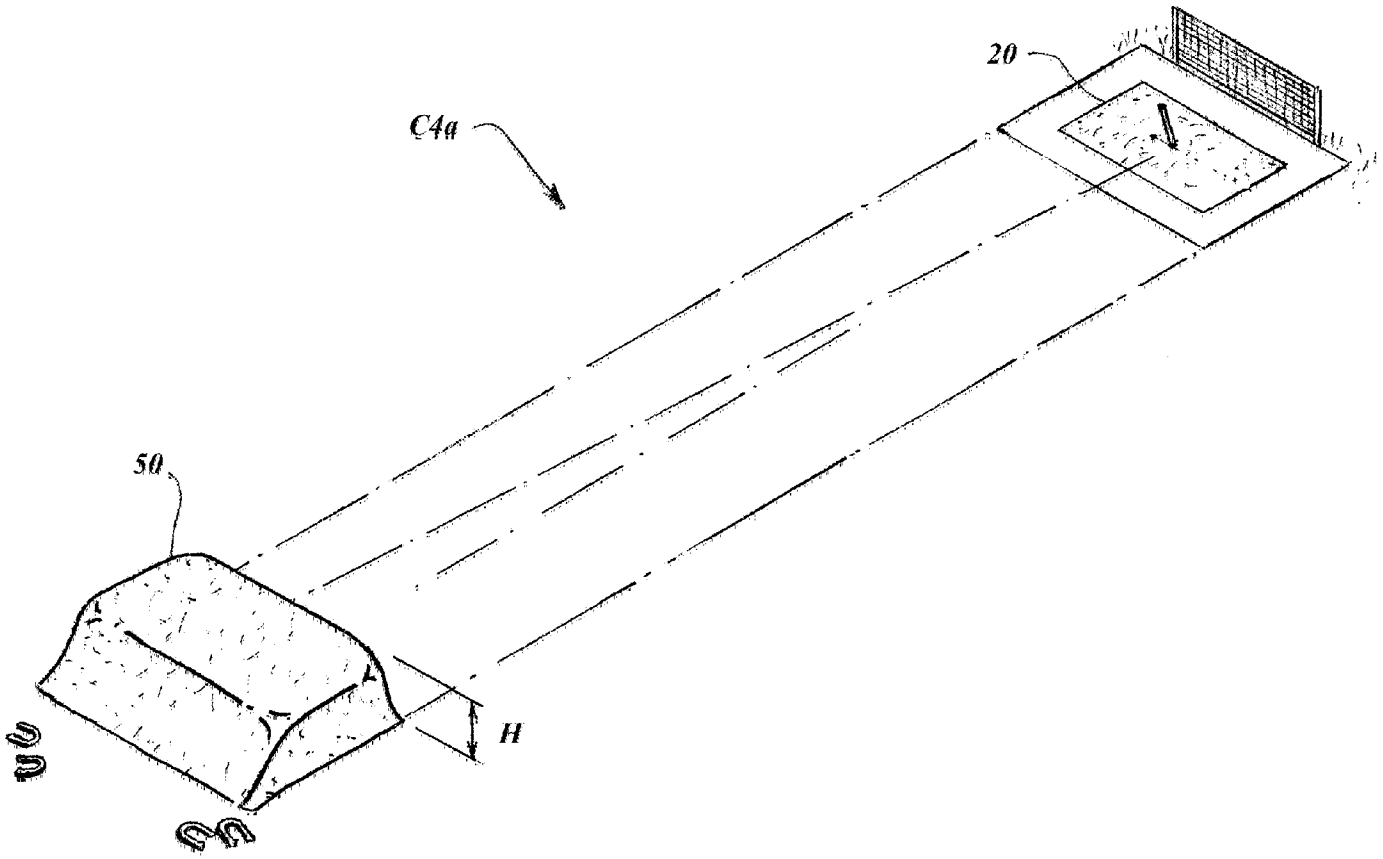
FIG. 6A is an enlarged isometric view of the first part of the fourth course C4A.
Figure 6B:
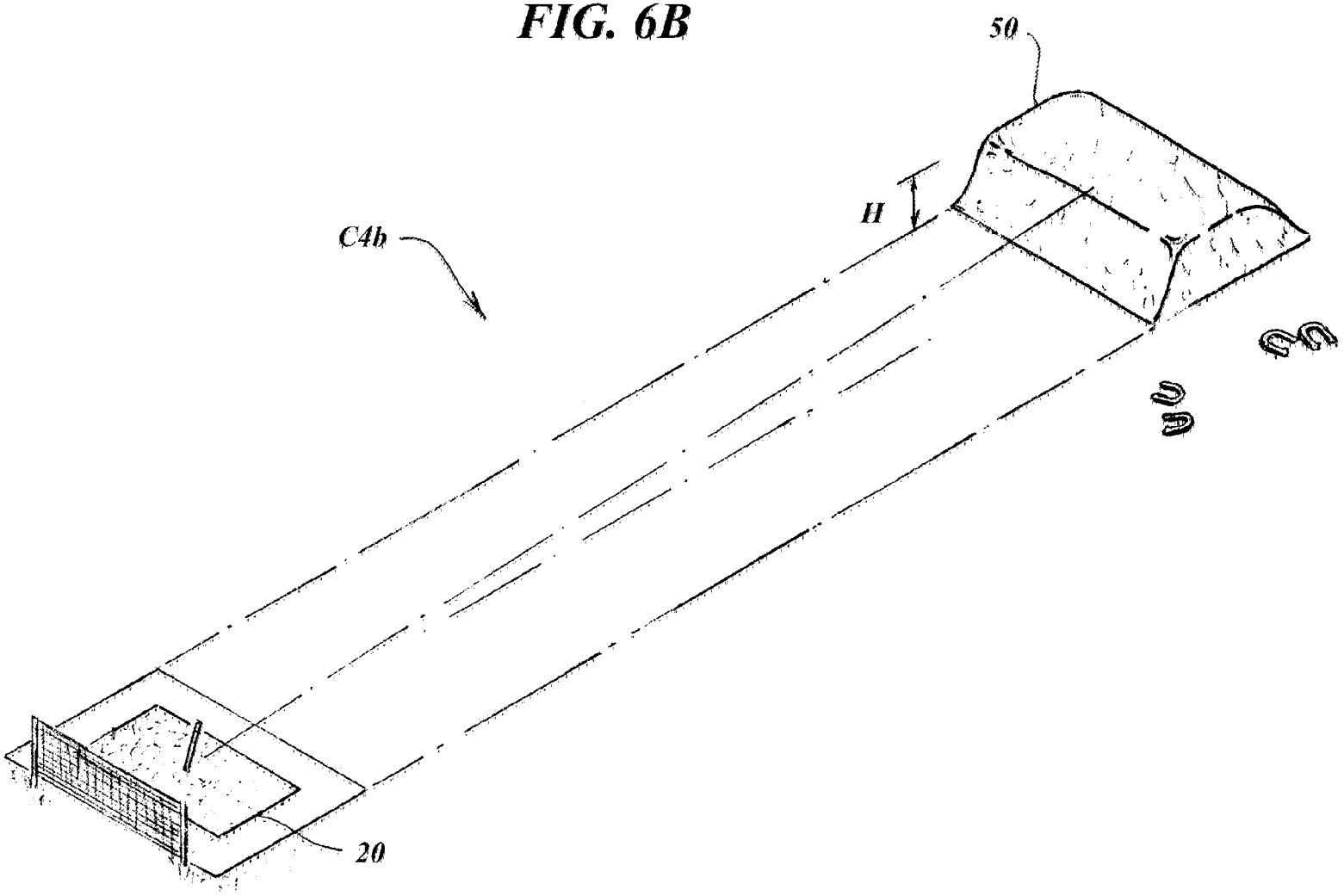
FIG. 6B is an enlarged isometric view of the second part of the fourth course C4B.

FIG. 6A represents course C4*a* (Elevated Down Flyer Side A) wherein there is only one horseshoe pit 20 and the throwing area is an elevated zone 50. Throwing zone 50 is at a height H of 24 inches resulting in a downward trajectory when players are throwing their horseshoes towards horseshoe pit 20. Course C4*b* (Elevated down Flyer Side B) is shown in FIG. 6B and is essentially a mirror image of course C4*a* allowing players to throw their horseshoes in the opposite direction.

Figure 7:
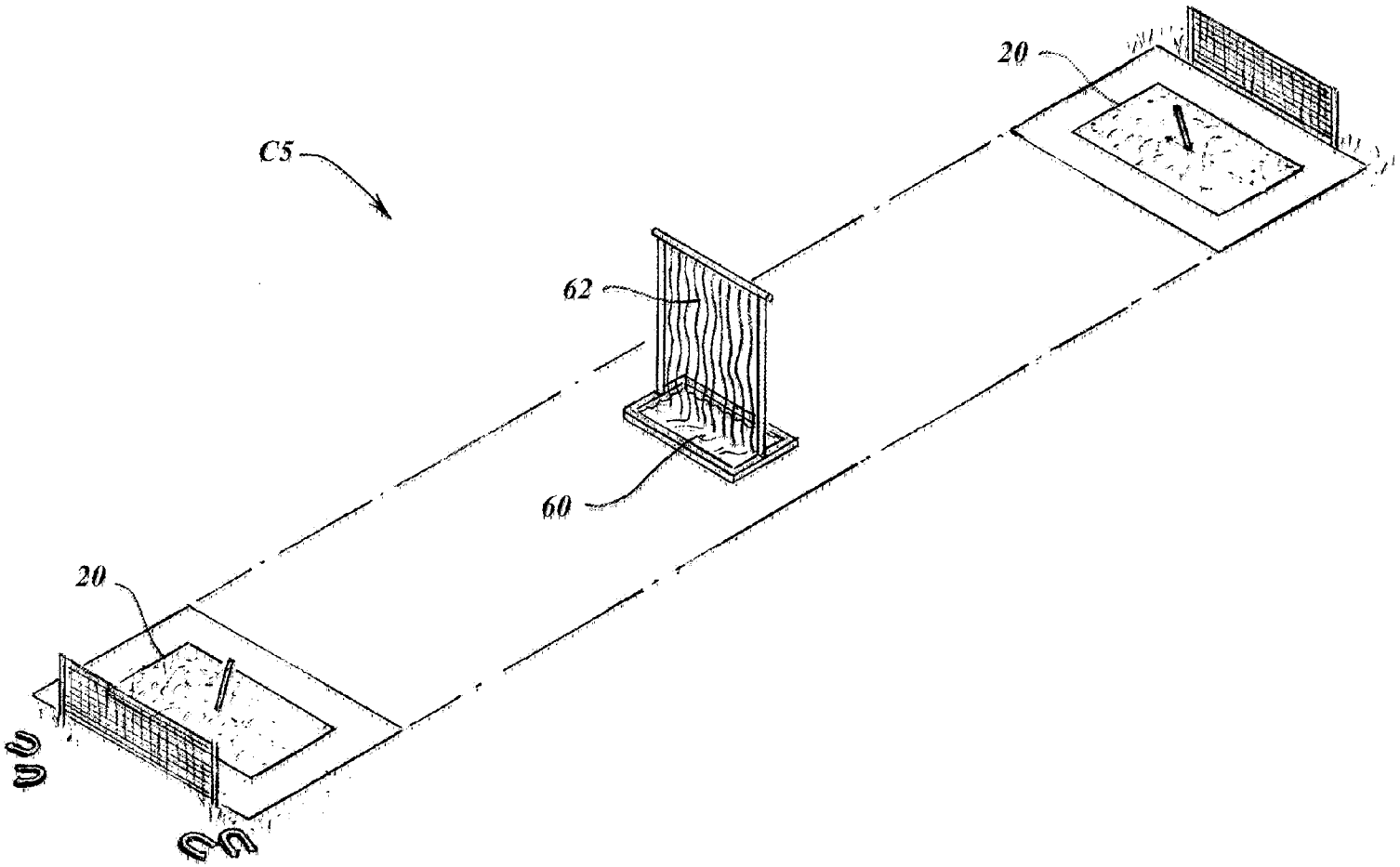
FIG. 7 is an enlarged isometric view of the fifth course C5.

FIG. 7 is a view of course C5 (Waterfall) which has a pond 60 and waterfall 62 as the challenge. The pond 60 is 24 inches by 48 inches and the waterfall 62 is 72 inches tall.

Figure 8A:
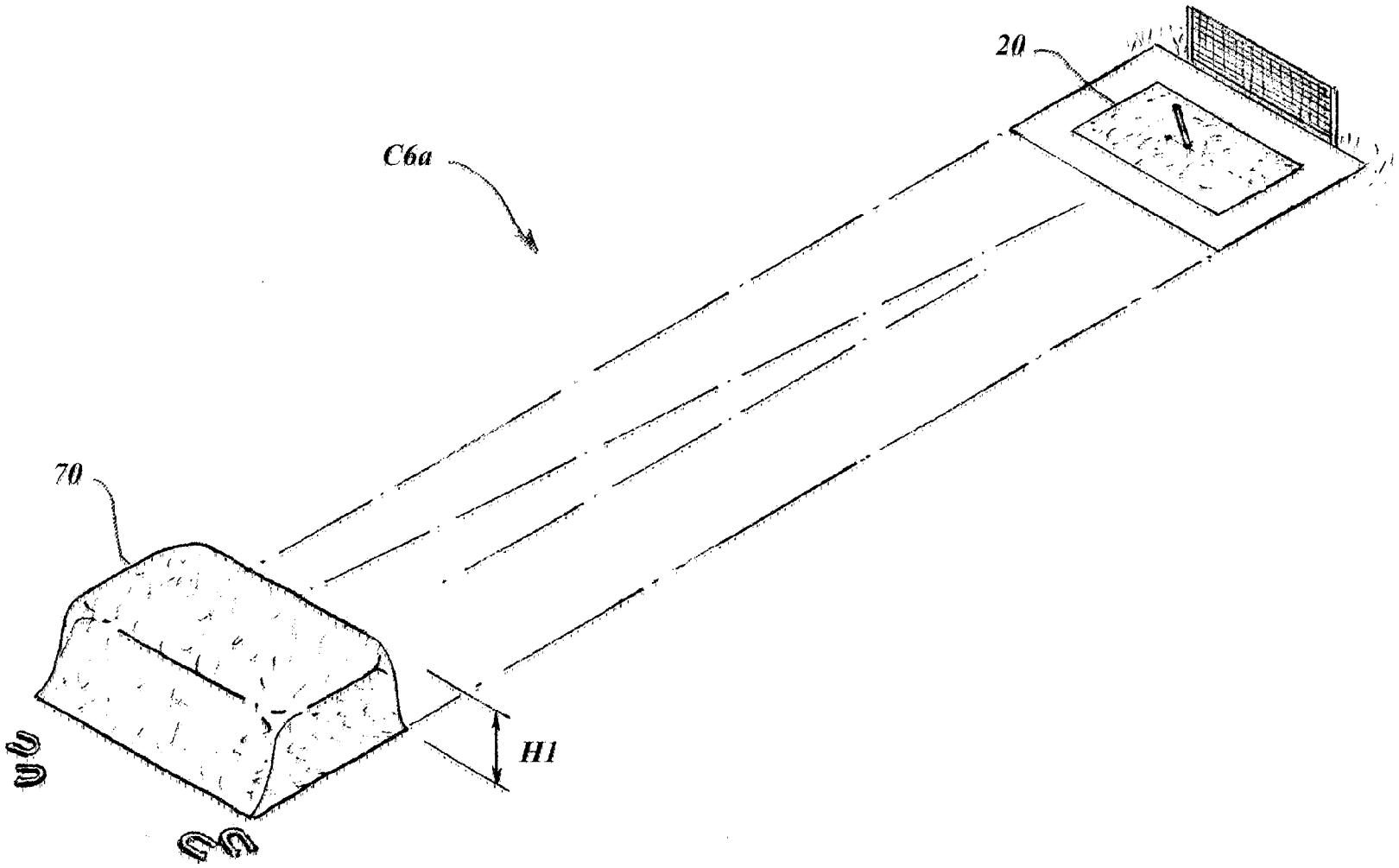
FIG. 8A is an enlarged isometric view of the first part of the sixth course C6A.
Figure 8B:
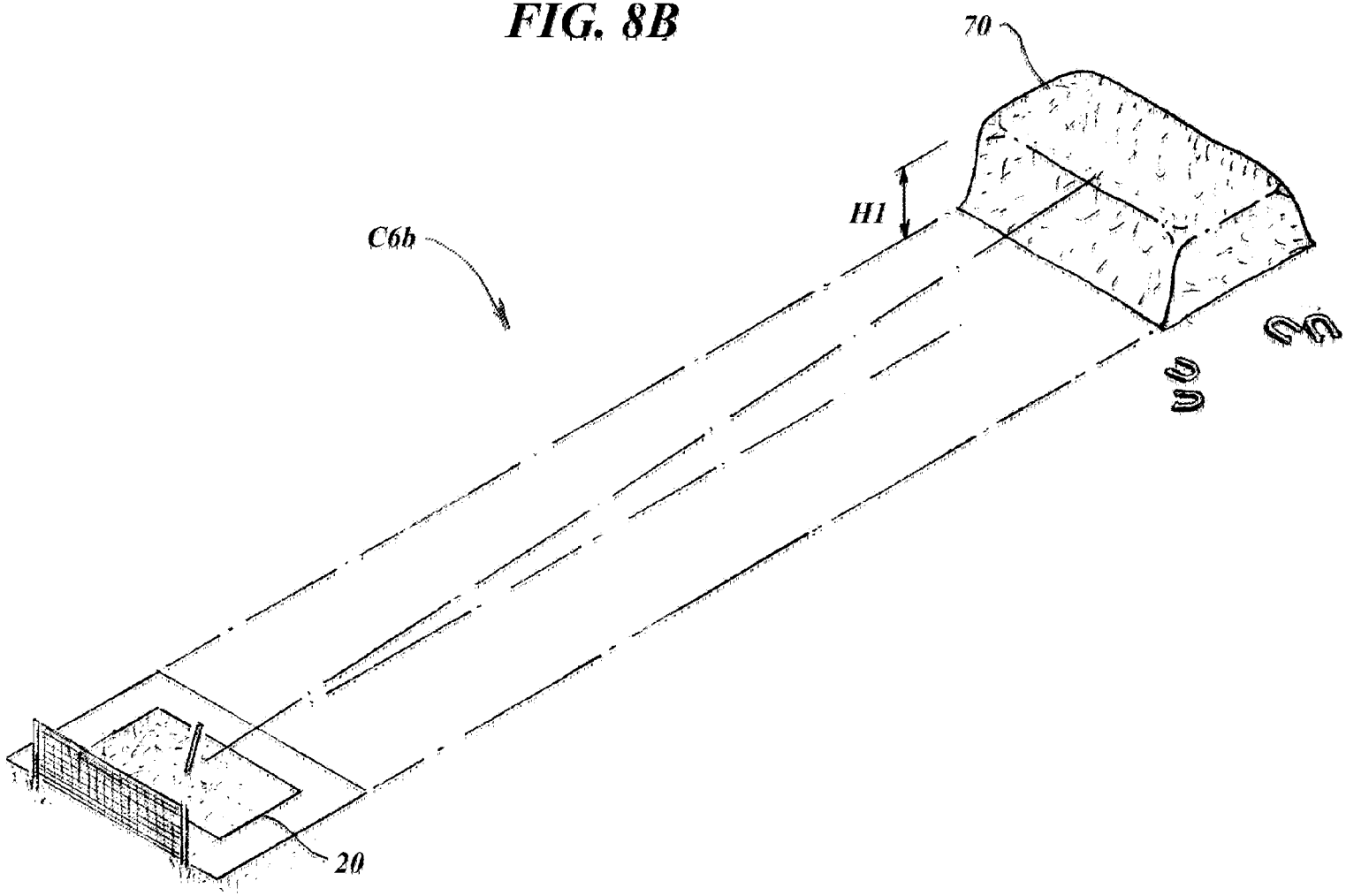
FIG. 8B is an enlarged isometric view of the second part of the sixth course C6B.

FIGS. 8A and 8B show courses C6*a* (High Flyer Side A) and C6*b* (High Flyer Side B) respectively. These two courses are similar to courses C4*a* and C4*b* as described above; the difference is that the throwing zone 70 is at a height H1 of 32 inches.

Figure 9A:
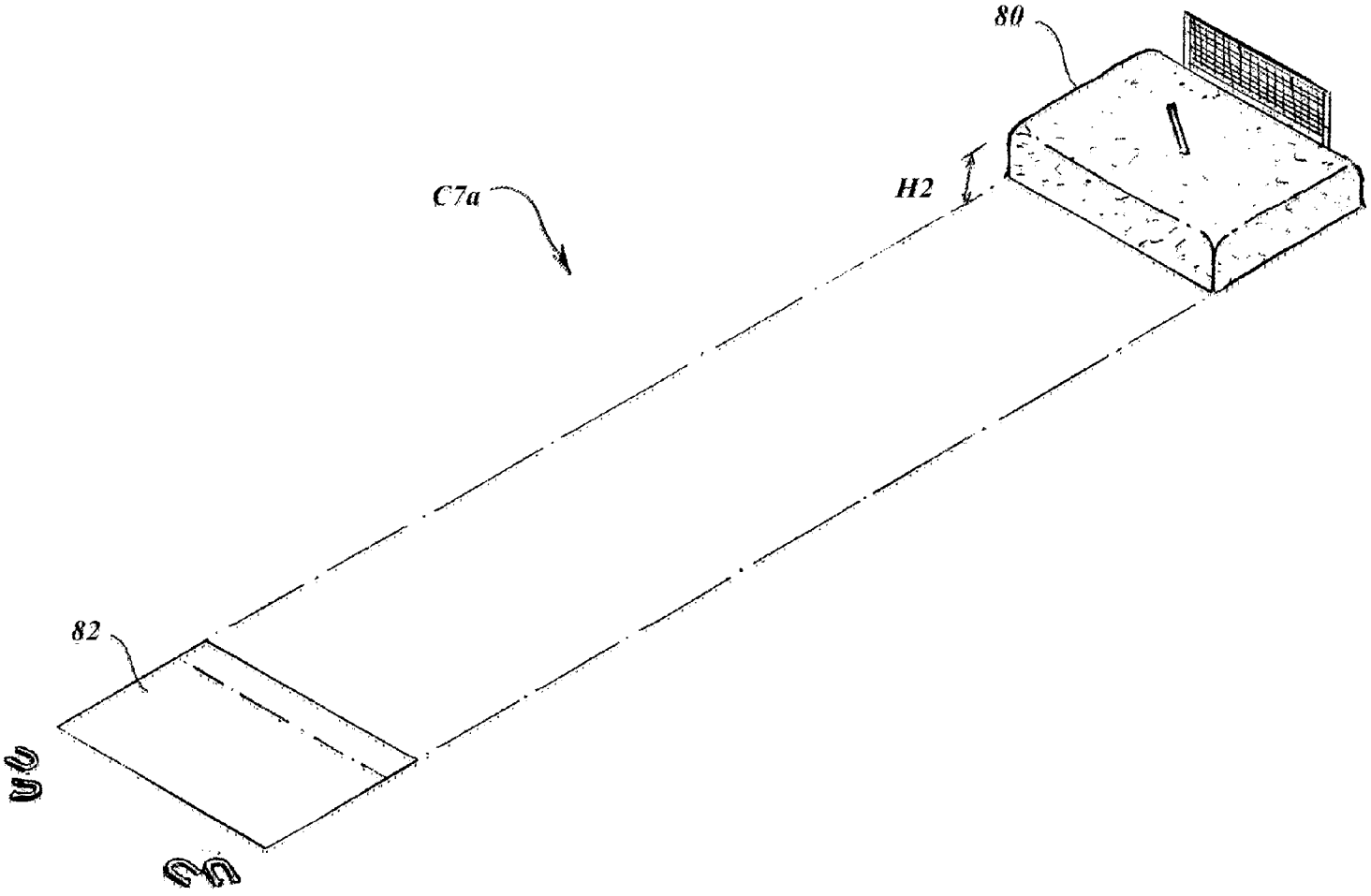
FIG. 9A is an enlarged isometric view of the first part of the seventh course C7A.
Figure 9B:
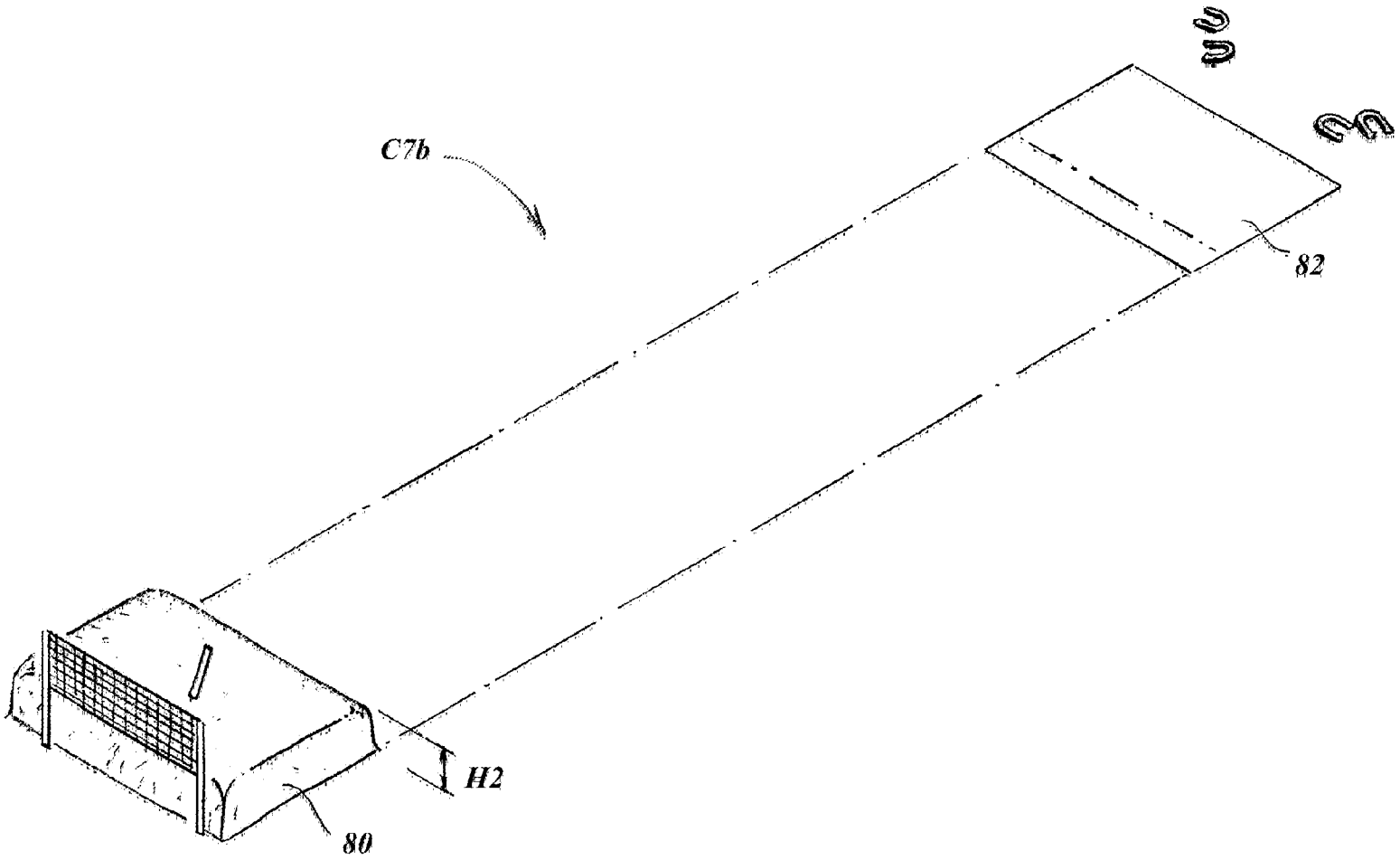
FIG. 9B is an enlarged isometric view of the second part of the seventh course C7B.

FIG. 9A shows course C7*a* (Rise & Fall Side A) that is comprised of a ground level throwing zone 82 and an elevated landing zone 80. The landing zone 80 is at a height 112 of 16 inches resulting in an uphill trajectory for the players when throwing their horseshoes. Course C7*b* (Rise & Fall Side B) is shown in FIG. 9B and is essentially a mirror image of course C7*a* allowing players to throw their horseshoes in the opposite direction.

Figure 10:
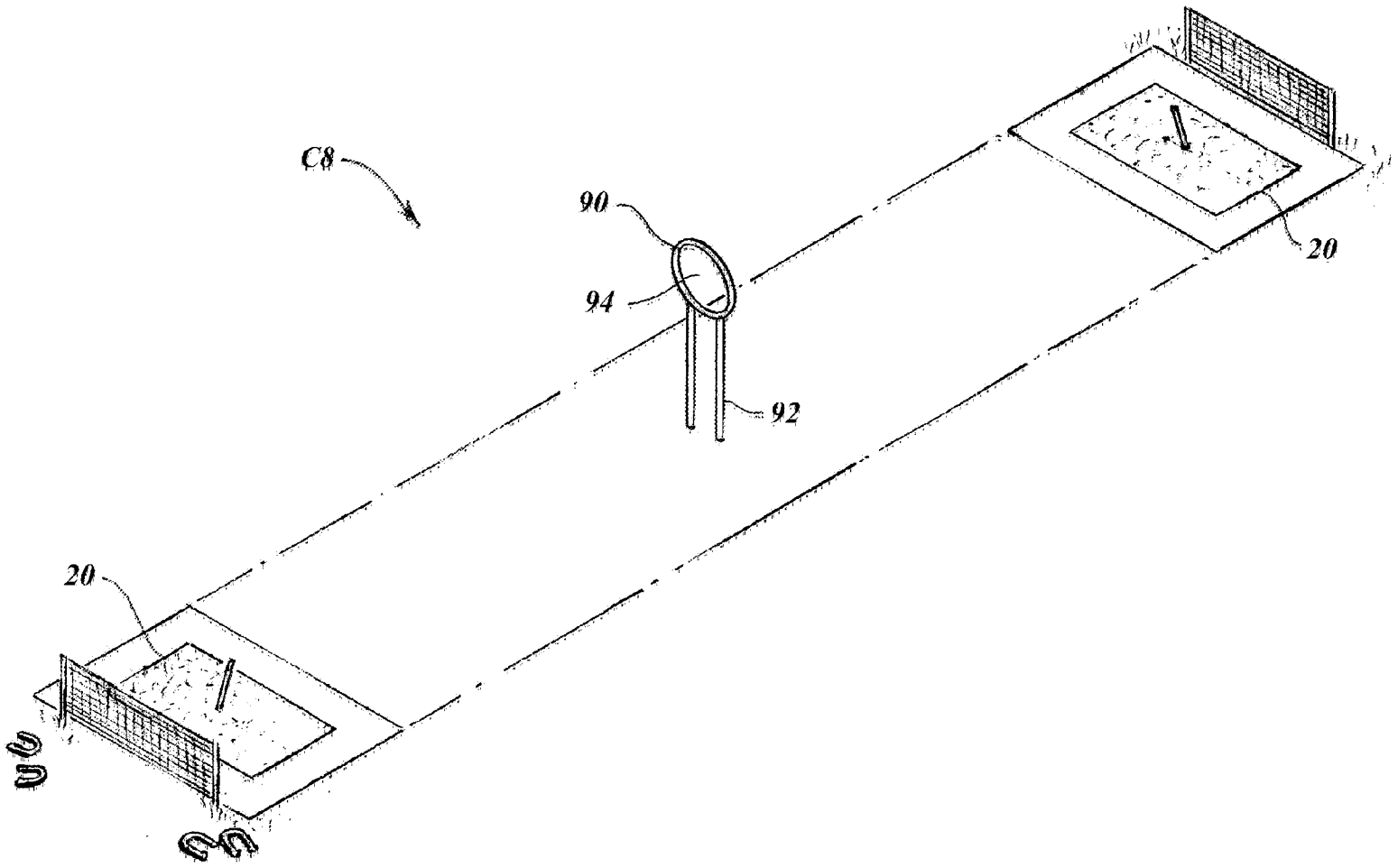
FIG. 10 is an enlarged isometric view of the eighth course C8.

FIG. 10 depicts course C8 (King of Ringers) whereby the challenge is a centrally located upright hoop 90 and two posts 92. The diameter of the hoop 90 is 28 inches and has a central opening 94. The post 92 is 40 inches high resulting in an overall height of 78 inches for the combination of post 92 and hoop 90. Optionally, the hoop can be an oval 28 inches by 38 inches.

Figure 11:
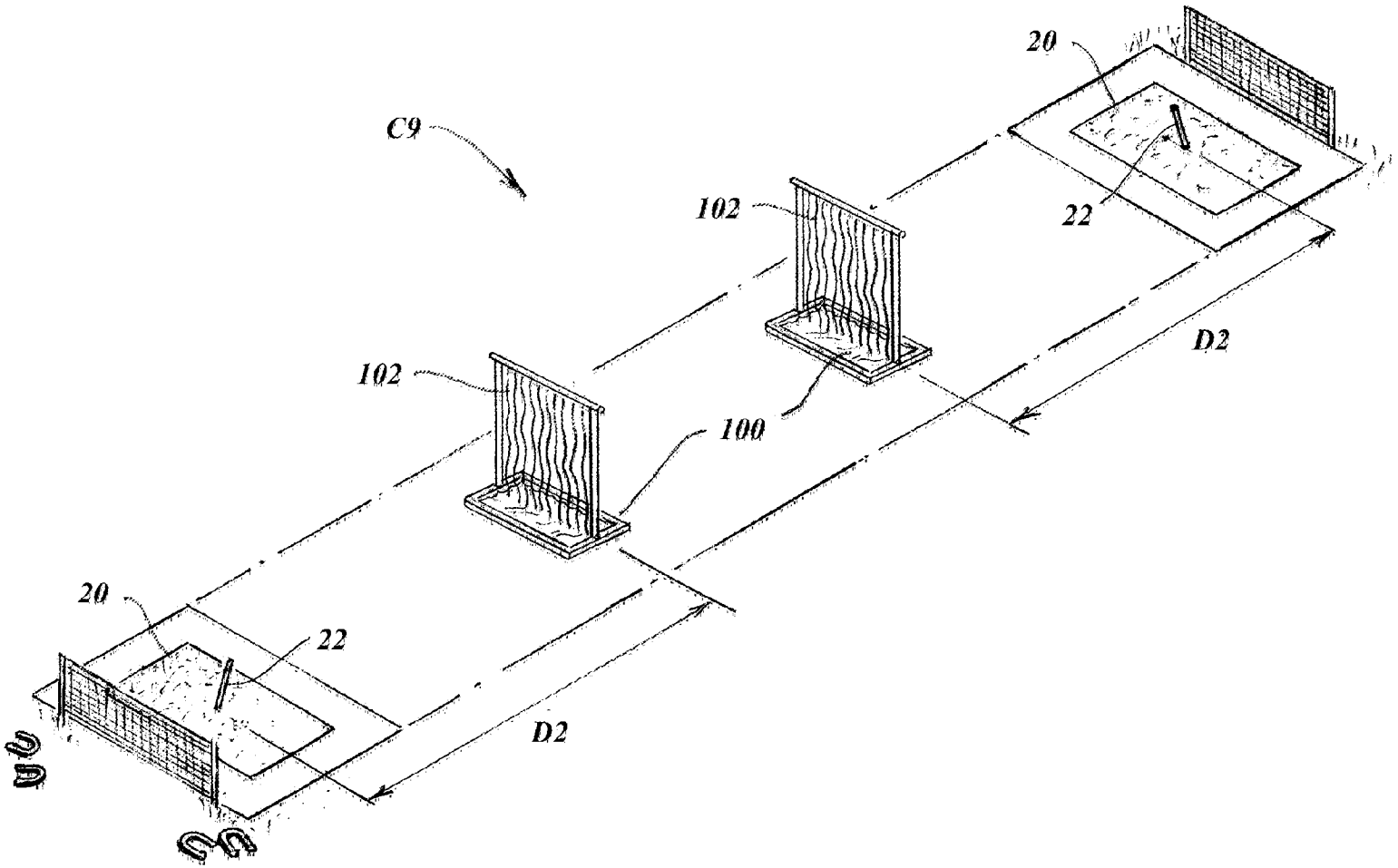
FIG. 11 is an enlarged isometric view of the ninth course C9.

FIG. 11 shows course C9 (Fountains of Water) wherein there are two pond and waterfall challenges. Ponds 100 and waterfalls 102 are sized the same as the waterfall described above in conjunction with FIG. 7. Each of the ponds 100 and waterfalls 102 are spaced a distance D2 of 13' from the stakes 22 as can be seen in the drawing.

The following is an example of how one version of the game could be played. It should be realized that various different rules may be formulated. The players have a coin toss to determine who throws first. There will be no practice throws or warm-ups on the courses, but only specific areas set aside for such activities. The players then take alternating turns throwing their horseshoes 28 towards the stake 22 at the opposite end of each course. The best shot, a ringer, counts for three points. A ringer is when the open portion of horseshoe 28 is encircled around the stake 22. Next on the point scale is a leaner which counts for two points. A leaner is when horseshoe 28 is positioned at an angle adjacent stake 22. Lastly, one point is awarded for the player's horseshoe that is closest to the stake 22. During play on courses C1, C2, C3, C5, C8 & C9 players will throw from both ends of the course. Courses C4*a*, C4B, C6*a*, C6*b*, C7*a* & C7*b* allow for only throwing horseshoes from one end. All players throw 8 times on each of the nine courses for a maximum total on each course of 24 total points and a possible 9 course maximum total of 216 points. Players tally their scores at the end of each course and throughout the game and after completing the game will then add up all of their points to determine a winner, the objective being the highest point total. Preferably the horseshoes will remain at each course for the next player.

Each of the horseshoe courses on the playing field is of varying configuration and has differing challenges and degrees of difficulty. The players traverse sequentially from one horseshoe course challenge to the next while keeping score and tabulating the scores at the end of the game to determine a winner. The layout and sequence of the game along with the associated challenges can be configured to create any number of variations desired and is not limited to what is shown in the drawings.

The dimensional layout of each of the horseshoe courses is similar to but not limited to the standard sizes and distances of the conventional horseshoe game. For example, the distance between stakes or posts is normally forty feet; the proposed invention layout may be thirty-eight feet for men, thirty-six feet for women and varying distances for children.

The throwing distance can be altered by employing a throwing line at each end of a course with marked throw lines for men, women and children. The challenges for each course can be adjusted to create numerous degrees of difficulty depending on the final objective.

The overall game layout 10 can be configured a number of different ways to accommodate varying spaces available for installation whereby the overall game objective remains the same with players progressing throughout a series of different challenges. The game conventionally would be played outdoors during daylight hours but artificial lighting can be utilized to extend playing hours. The game could also be played in an indoor facility with artificial turf or other floor coverings. Other versions of the game can also include weighted plastic or rubber horseshoes for safety reasons or the physical strength capabilities of the players. The invention is not limited to throwing horseshoes per se. The throwing objects could be of different shapes and sizes.

In one proposed application the horseshoe game could be created within a commercial venue such as an indoor or outdoor recreational business. Other applications can include amusement parks, local and county park systems, country clubs for family recreation & neighborhood play areas.

The invention is not limited to full scale physical installations. The horseshoe game could be created and played in a digital environment such as video games for computers, cell phones, tablet computing and gaming consoles.

Although this disclosure describes illustrative embodiments of the invention in detail, it is to be understood that the invention is not limited to the precise embodiments described. The specification and drawings are, accordingly, to be regarded in an illustrative rather than a restrictive sense. Various adaptations, modifications and alterations may be practiced within the scope of the invention defined by the appended claims.

The invention claimed is:

1. A horse shoe game facility comprising a playing field for a horse shoe game and at least one horse shoe for use by players, the playing field including a. a planar playing field;

b. a plurality of horseshoe courses arranged on the playing field, each horseshoe course comprising an elongated planar portion having opposed ends, a width and a horseshoe pit on at least one of the opposed ends of the elongated planar portion, the horse shoe pit having a stake rising above the pit, and wherein each of the courses includes a challenge for the player, wherein the challenge is an obstacle positioned between the opposed ends of the elongated planar portion and traverses the width of the course, the obstacle being at least one of the following challenges:

i. a raised hedge;

ii. a pond positioned in front of each horseshoe pit;

iii. a raised waterfall that flows into a pond;

iv. a plurality of raised waterfalls that each flow into a pond;

v. a raised hoop wherein the player has to throw the at least one horseshoe over the obstacle towards the stake;

c. the plurality of horseshoe courses arranged on the playing field in a pattern, wherein the players traverse the playing field sequentially along a predetermined game path by tossing the at least one horseshoes on each horseshoe course to traverse the game path of horseshoe courses to complete the game.

2. The horseshoe game facility of claim 1, wherein at least one of the plurality of the horseshoe courses has the horseshoe pit on each of the opposed ends of the elongated planar portion of the horse shoe course.

3. The horseshoe game facility of claim 1, wherein at least one of the plurality of the horseshoe courses has a safety net at each end of the horseshoe course to prevent the horseshoes tossed by the player from crossing into adjacent horseshoe courses.

4. The horseshoe game facility of claim 1, wherein at least one of the challenges for at least one of the courses is the raised, hedge positioned between the opposed ends of the elongated planar portion, wherein the player has to throw the at least one horseshoe over the raised hedge towards the stake.

5. The horseshoe game facility of claim 1, wherein the challenge for at least one of the courses is the pond positioned in front of each horseshoe pit, wherein the player has to throw the at least one horseshoe over the pond towards the stake.

6. The horseshoe game facility of claim 1, wherein at least one of the courses has an elevated zone positioned at one of the opposed ends of the elongated planar portion and the horseshoe pit is positioned at the other opposed end of the elongated planar portion, the stake rising above the pit, wherein the player has to throw the at least one horseshoe towards the stake standing on the elevated zone.

7. The horseshoe game facility of claim 1, wherein at least one of the challenges for at least one of the courses is the raised waterfall that flows into the pond positioned between the opposed ends of the elongated planar portion, wherein the player has to throw the at least one horseshoe over or through the raised waterfall towards the stake.

8. The horseshoe game facility of claim 1, wherein at least one of the challenges for at least one of the courses is the plurality of raised waterfalls that each flow into the pond, the raised waterfalls positioned between the opposed ends of the elongated planar portion, wherein the player has to throw the at least one horseshoe over or through the raised waterfalls towards the stake.

9. The horseshoe game facility of claim 1, wherein at least one of the courses has an elevated horseshoe pit positioned at one of the opposed ends of the elongated planar portion, the stake rising above the pit and a throwing zone positioned at the other opposed end of the elongated planar portion, wherein the player has to throw the at least one horseshoe towards the stake on the elevated horseshoe pit standing on the throwing zone below the elevated horseshoe pit.

10. The horseshoe game facility of claim 1, wherein at least one of the challenges for at least one of the courses is the raised hoop positioned between the opposed ends of the elongated planar portion, wherein the player has to throw the at least one horseshoe through the raised hoop towards the stake.

* * * * *